US005608314A

United States Patent [19]

Woo

[11] Patent Number: 5,608,314

[45] Date of Patent: Mar. 4, 1997

[54] INCREMENTAL OUTPUT CURRENT GENERATION CIRCUIT

[75] Inventor: Ann Woo, Cupertino, Calif.

[73] Assignee: Advanced Micro Devices, Inc., Sunnyvale, Calif.

[21] Appl. No.: 226,163

[22] Filed: Apr. 11, 1994

[51] Int. Cl.[6] ..... G05F 1/16

[52] U.S. Cl. ..... 323/313; 327/535

[58] Field of Search ..... 323/315, 316, 323/313, 314; 327/535, 536

[56] References Cited

U.S. PATENT DOCUMENTS

| | | | |
|---|---|---|---|
| 3,832,624 | 8/1974 | Gilmore et al. | 321/66 |
| 4,498,053 | 2/1985 | Katakura | 330/261 |
| 5,063,342 | 11/1991 | Hughes et al. | 323/315 |
| 5,355,077 | 10/1994 | Kates | 323/224 |

*Primary Examiner*—Peter S. Wong
*Assistant Examiner*—Rajnikant B. Patel
*Attorney, Agent, or Firm*—Benman Collins & Sawyer

[57] ABSTRACT

An incremental output current generation circuit is disclosed wherein a reference current and a reference voltage are established which follow a bias current which is then multiplied. A set of predetermined voltage reference points are established and the multiplied current supplied thereto. A ramping input voltage is compared to the established voltage referencing points by comparitors. The outputs of the comparators flag the highest voltage reference point which the value of the voltage exceeded. These outputs are sensed by a current generator thereby providing predetermined fractions of the reference current to be delivered at the output as the output source current. In such a manner, an incremental output source current is generated which is dependent on an input voltage level and predetermined incrementally by the value of an established reference current.

36 Claims, 15 Drawing Sheets

| | | | | | | | | |
|---|---|---|---|---|---|---|---|---|
| T24 | (20) | : | I4 | = | 20/32 | IR | = | 5/8 IR |
| T23 | (12) | : | I3 | = | 12/32 | IR | = | 3/8 IR |
| T22 | (8) | : | I2 | = | 8/32 | IR | = | 1/4 IR |
| T21 | (24) | : | I1 | = | 24/32 | IR | = | 3/4 IR |

FIG. 8

INCREMENTAL OUTPUT CURRENT GENERATION CIRCUIT

FIELD OF THE INVENTION

The present invention relates to circuits which generate an incremental output source current dependent on an input voltage level.

BACKGROUND OF THE INVENTION

New and improved processes have led to the more highly integrated and more reliable circuits which in turn have fueled the electronics industry. Process improvements allow for the fabrication of the circuits and chips into increasing densities and quantities with enhanced reliability characteristics. Structural improvements allow for greater circuit performance and control of power consumption with enhanced reliability as well. The advancement of chip density has led to the reduction of the size of the individual circuit components contained on the chip. These integrated-circuit chip densities have grown because of the ability to decrease the size of the individual devices (electronic components) contained on each chip. The benefits of the reduction in the size of the individual chip components have allowed for an increase in the circuit performance level because of the increased circuit speed. With the less distance the current must travel from component to component, the information contained therein can be processed within the chip in a shorter amount of time. More importantly, with density improvements the chip's circuits require less power to operate.

Although there are gains to be had from increasing component densities levels per chip, for the circuit designer these increased density levels have often led to increased frustrations concomitant with the design, development, and testing of the millions of circuit components contained on a single chip.

More particularly, in this art specific problems exist with establishing and maintaining proper bias conditions within the circuit which are independent of varying chip operating temperatures and differing supply voltage variations within the chip's many individual circuit components. In addition, additional problems are inherent in the manufacture of the chip wafer which may add process variations to the surface on which these many millions of components will be placed thereby changing resistances across the chip surfaces.

Because of the increasing complexity of the circuitry contained on a single integrated circuit (IC) chip, fluctuations in the current with temperature, supply voltage, and process variations can also often result in problems which may impact the design objectives of the particular circuit and its function. In other words, it is desirable in this art to be able to tighten circuit parameters given a wide variety of operating conditions and process variations effecting the source current.

SUMMARY OF THE INVENTION

The present invention is directed to circuits which generate an incremental output source current dependent on an input voltage level and predetermined incrementally by the value of an established reference current.

Briefly summarized, the present invention provides a novel incremental output current generation circuit is disclosed herein. In one embodiment of this invention, a reference current and a reference voltage are established by the combination of a transistor and a current mirror which follow the values of a bias current. The reference current is then multiplied by a current multiplication means. A set of predetermined voltage reference points are established in a voltage referencing means with sufficient current being supplied thereto by the current multiplication means. The ramping values of an input voltage are then compared to the established voltage referencing points in the comparison means the outputs of which flag the highest voltage reference value which the input voltage exceeded. These comparitor outputs trigger in a current generation means predetermined incremental current fractions of the established reference current. These incremental currents are delivered to the output as the output current. In such a manner, an incremental output source current is generated which is dependent on an input voltage level and predetermined incrementally by the value of an established reference current.

In another embodiment disclosed, a reference current and a reference voltage establish bias current by the combination of a transistor and a current mirror. The reference current is then multiplied in a current multiplication means. A set of predetermined voltage reference points are established in a voltage referencing means with sufficient current being supplied thereto by the current multiplication means. The ramping values of an input voltage are then compared to the voltage reference points in a comparison means the outputs of which flag the highest voltage reference value which the input voltage exceeded. These outputs are then directed into a latching means for holding the signal steady and a reset means for establishing stable initial conditions in the latching means. The latching means outputs trigger a predetermined incremental value of the reference current which is delivered at the output as the output current. In such a manner, an incremental output current is generated which is dependent on the ramping values of an input voltage and predetermined incrementally by the value of an established reference current.

BRIEF DESCRIPTION OF THE DRAWINGS

In order to more fully understand the present invention, a more particular description of the invention will be rendered by reference to the accompanying drawings in which:

FIG. 8 is a table of the incremental values of the reference current that can be delivered at the output;

DETAILED DESCRIPTION OF THE PREFERRED EMBODIMENT

The present invention is directed to circuits which generate an incremental output source current by sensing an input voltage and predetermined incrementally by the value of an established reference current.

The foregoing description of the preferred embodiment of the present invention is given herein with specific reference being made to the appended drawings wherein like parts are designated with like symbols throughout.

It should be understood at the onset of this detailed description of the preferred embodiment of the present invention that the electronic circuit techniques as described herein with specificity are such that in order for one skilled in this particular art to readily understand them one should command at the very least an understanding of electronic circuits and their components and functions.

Figure 1:
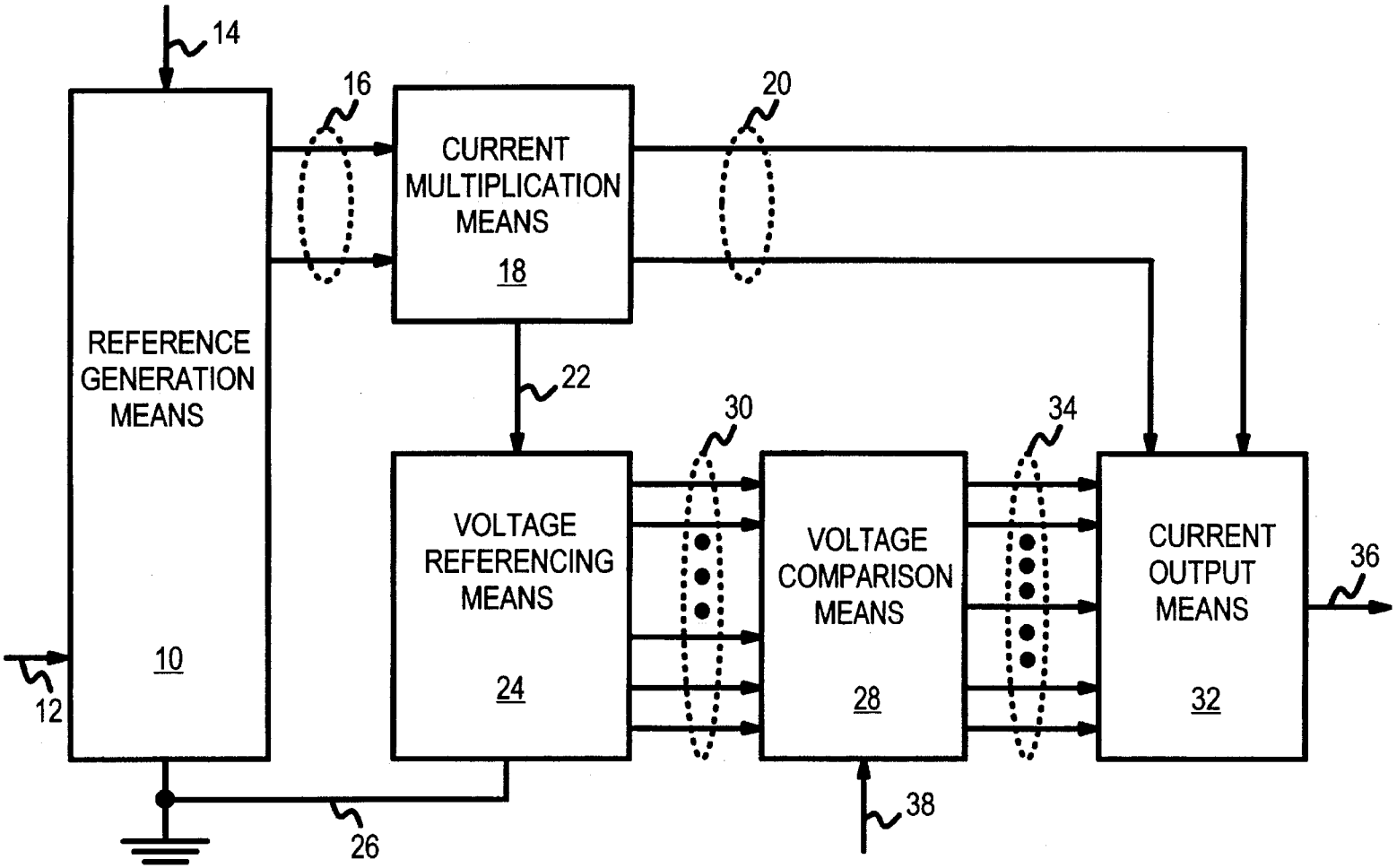
FIG. 1 is a block diagram illustration of one embodiment of the incremental output current generation circuit of the present invention.

Reference is now made to FIG. 1 which is a block diagram illustration of one embodiment of the incremental output current generation circuit of the present invention. A reference generation means 10 accepts a bias current 12 and a low voltage power supply 14 both connected to a common ground as shown in order to establish a reference current IR therethrough and a reference voltage VR across lines 16. The reference voltage VR is dependent on the reference current which in turn is linked to the value of the bias current IBIAS. A current multiplication means 18 uses the reference current IR as a baseline to be multiplied. The multiplied current is driven into the voltage referencing means 24 over 22. The voltage across 16 is also made available across 20. The voltage referencing means 24 is tied to a common ground with the reference generation means 10 by 26. The voltage referencing means 24 establishes a series of voltage reference points therethrough which are directed across a plurality of outputs 30 which tie into the comparator means 28 for comparison with the ramping level of an input voltage 38. In one embodiment, the plurality of outputs 34 of the comparitor means 28 are directed into a current output means 32 which quickly generates a stable output current 36. This output current is tied to the level of the input voltage 38. With such a circuit, because the output current 36 can be quickly ramped and held stable external circuit turn-on time can be made much quicker.

Figure 2:
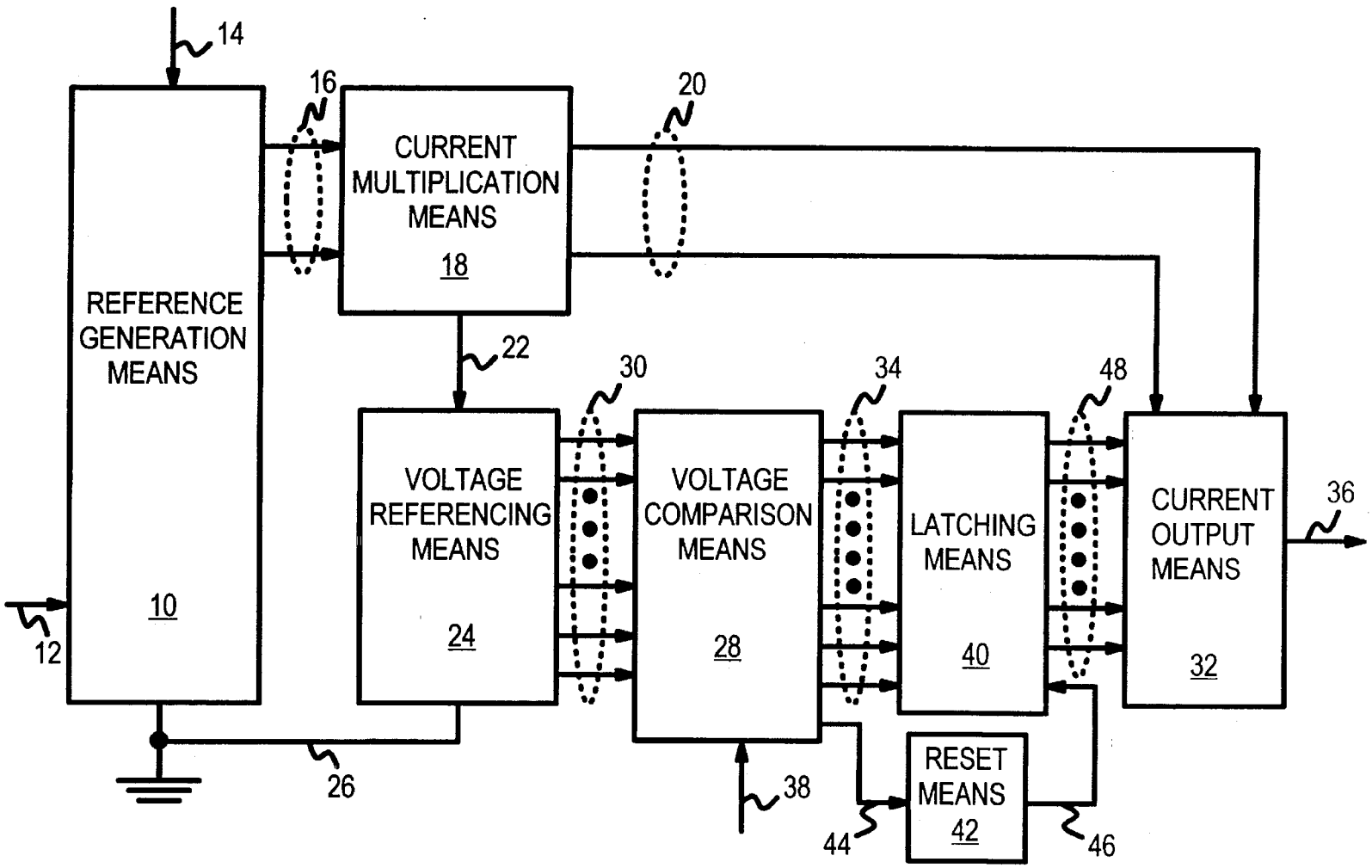
FIG. 2 is a block diagram illustration of the preferred embodiment of the incremental output current generation circuit of FIG. 1 incorporating a latching means and a reset means.

Reference is now being made to FIG. 2 which is a block diagram illustration of the preferred embodiment of the incremental output current generation circuit of FIG. 1 incorporating a latching means 40 and a reset means 42. In this embodiment the outputs 34 tie the voltage comparison means 28 to the latching means 40. At least one additional output 44 from the comparator means 28 ties into the reset means 42. The reset means has at least one output 46 directed into the latching means 40 in order to effectuate a reset of the latches. Outputs 48 connect the latching means to the current output means 32 in order to trigger the current output in a manner as with that of FIG. 1.

Understand that the diagrams of FIGS. 1 and 2 illustrate two embodiments of the circuit of the present invention the particulars of which will now be explained in detailed wherein like parts are similarly referenced throughout.

It should be understood that points, such as those labeled A1, A2, and A3 are for connecting the circuit configuration of one diagram to that of another wherein like labeled connection points are designated to be electrically joined. For instance, point A1 of FIG. 3A is only connected to point A1 of FIG. 4.

Figure 3A:
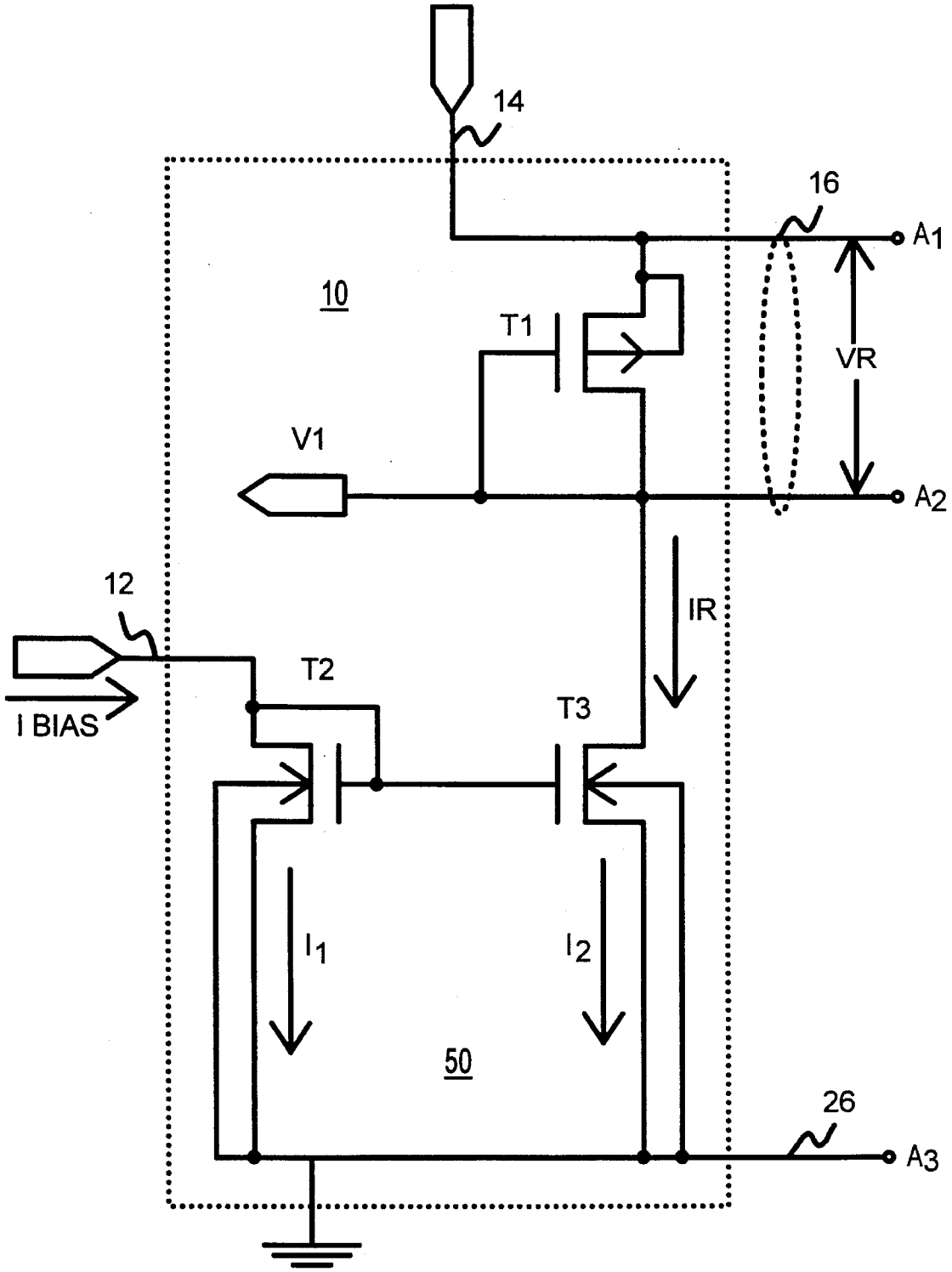
FIG. 3A is a diagram of one embodiment of the reference generation means of FIGS. 1 and 2 incorporating a single transistor and a two transistor configured current mirror.

Attention is now respectfully directed to FIG. 3A which is a diagram of one embodiment of the reference generation means 10 of FIGS. 1 and 2 incorporating a single transistor T1 and a two transistor configured current mirror means 50. A supply voltage 14 is connected to transistor T1. A bias current, labeled IBIAS, is made to flow in the direction of the accompanying arrow to ground. The source voltage can be any power supply preferably +5 V. An output voltage, labeled V1, is available as a relatively stable voltage source for use outside the circuit of the present invention. For example, V1 can be used in conjunction with other transistors for mirroring current levels elsewhere in order to force the same current levels in another circuit.

With reference still being made to FIG. 3A, a pair of transistors, labeled T2 and T3, are arranged in a mirror configuration. Since the configuration of the mirroring of current is well known in the arts and one skilled in this art should already be familiar with its construction, functionality, and purpose a further explanation of the particulars of the function of the mirror configuration is omitted herein. However, what is important in this regard is that I1 is the same as the bias current IBIAS. If T3 is made the same as T2 then I2 is equal to I1 and the amount of reference current IR that is made to flow through T1 will be the same as that of I2.

With the flow of the reference current IR through T1 an accompanying voltage potential develops across T1. This voltage is between output lines 16 and is labeled VR between connecting points A1 and A2. This reference voltage is in direct relationship to be established reference current and thus the bias current. The reference voltage is made available to the current multiplication means 18.

Figure 3B:
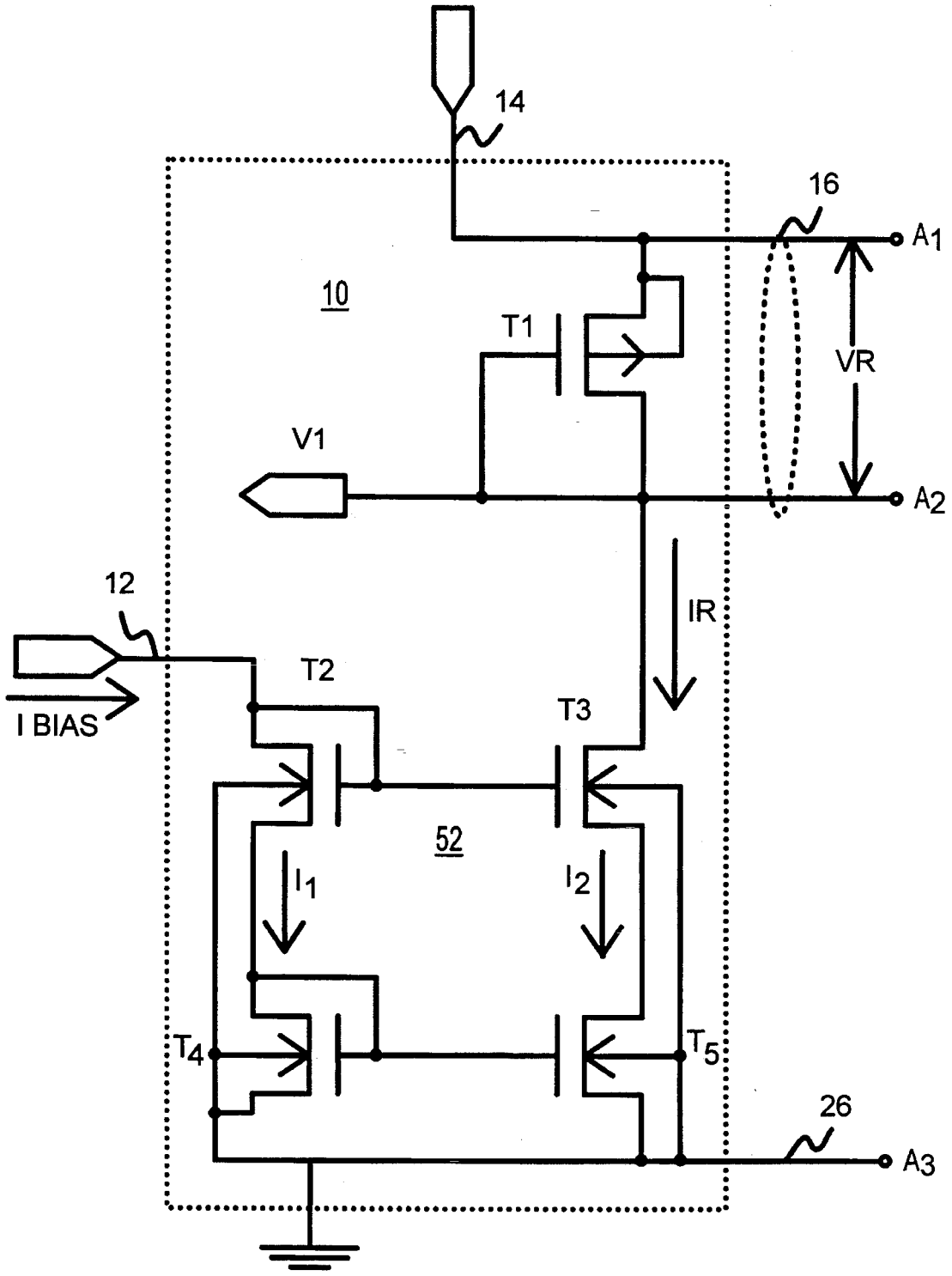
FIG. 3B is a diagram of an alternative embodiment of the reference generation means of FIGS. 1 and 2 illustrating a four transistor configured current mirror.

Attention is now directed to FIG. 3B which is a diagram of an alternative embodiment of the reference generation means 10 of FIGS. 1 and 2 illustrating a four transistor configured current mirror means 52 wherein a cascode configuration is effectuated by the addition of transistors T4 and T5. The effect of the addition in this embodiment is to make the configuration of the current mirror means 50 of FIG. 3A less sensitive to the kinds of noise typically associated with the flow of the bias current therethrough and to make the overall current mirror configuration less sensitive to fluctuations in the level of the bias voltage connected there across. As such, an increased element of stability is added the overall circuit of the present invention.

Figure 3C:
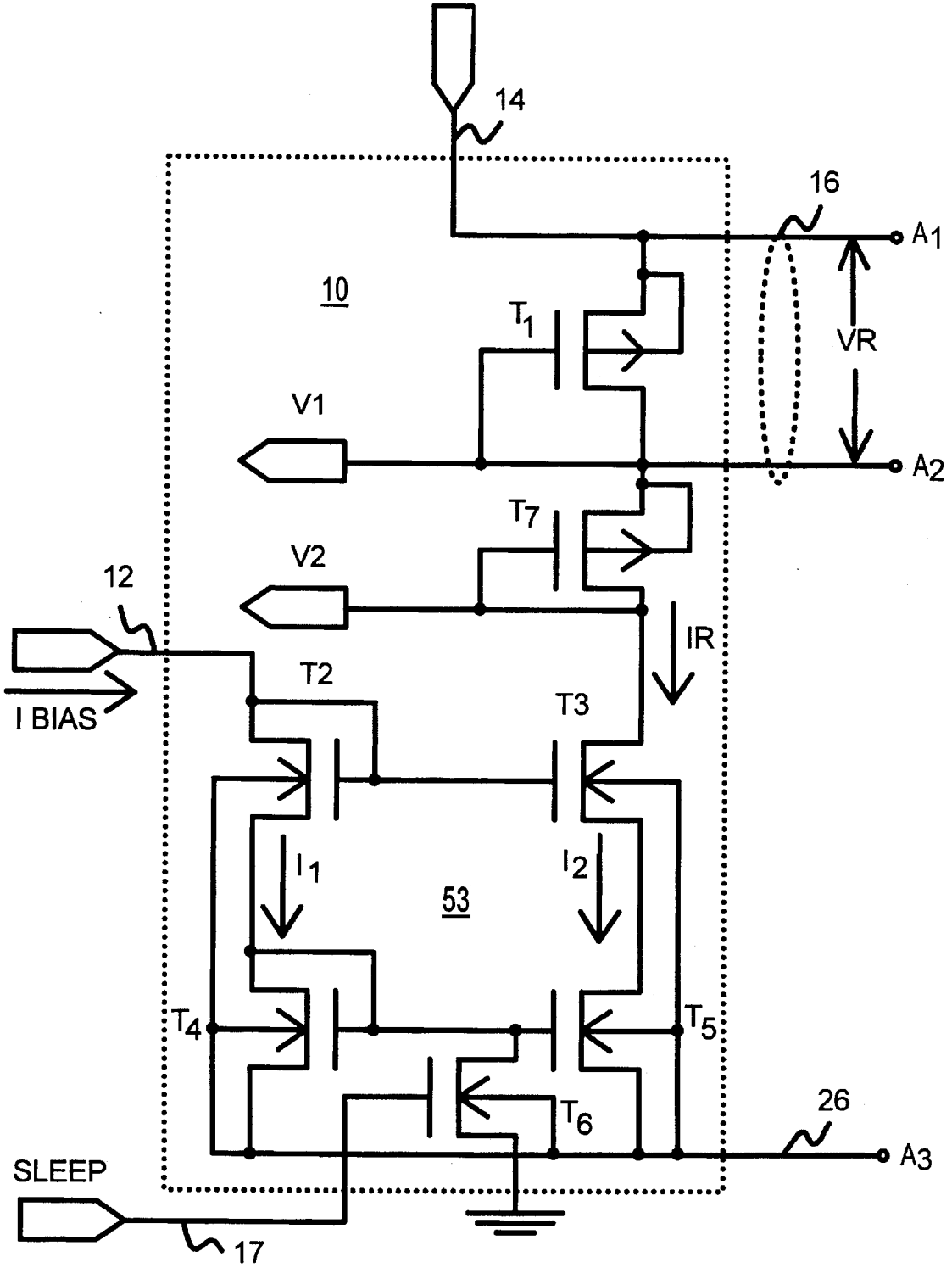
FIG. 3C is a diagram of another alternative embodiment of the reference generation means of FIGS. 1 and 2 incorporating an additional top transistor and a five transistor configured current mirror means having a sleep-mode means therewith.

In yet another alternative embodiment, attention is directed to FIG. 3C which is a diagram of the reference generation means 10 of FIGS. 1 and 2 incorporating an additional top transistor T7 and a five transistor configured current mirror means 53 with a sleep-mode means 17. With regard to FIG. 3C, attention is initially directed to transistor T1 which is cascoded by transistor T7. The addition of this transistor as configured affords the top portion of the circuit of the present invention the added protection from unwanted fluctuations and variations in the level of the source voltage power supply 14 with respect to ground. This adds stability to the reference voltage developed across 16 by the flow of the reference current therethrough. In addition, another voltage reference point, labeled V2, can be made available for use in other circuits in a fashion similar to that of V1. Since multiple transistors or additional protective circuitry could be incorporated herein either with the single transistor T1, the cascode configuration of T1 and T7, or in replacement therefore, other embodiments of this portion of the present invention are to be considered equivalent to this embodiment and within the scope of the present invention.

Attention is again directed to the bottom half of FIG. 3C. In this embodiment, the sleep-mode means 17 comprises a transistor T6 which is connected between transistors T4 and T5 and which is tied at one end to ground and a state generation line. As shown, transistor T6 is connected to a state generation line, designated SLEEP. In this configuration, when the SLEEP line goes HIGH, for instance to +5 V, transistor T6 is turned ON in effect shunting the bias current directly to ground. This inhibits the mirror of current I1 into I2 thereby prohibiting the flow of the reference current. With this configuration, a mechanism can be added to the mirror such that the draw of the reference current can be turned ON/OFF. If the reference current does not flow then no reference voltage is developed across lines 16. This shuts down the current multiplication means 18. In effect, this particular embodiment enables the addition of a level of control to the functionality and operability of the current mirror and to the reference generation means 10 and therefore to the rest of the circuit of the present invention. Other configurations which also effectuate an enablement of the reference current and reference voltage by enabling/disabling the reference generation means 10 are envisioned herein and are to be considered equivalent to this particular embodiment and within the scope of the present invention.

Figure 4:
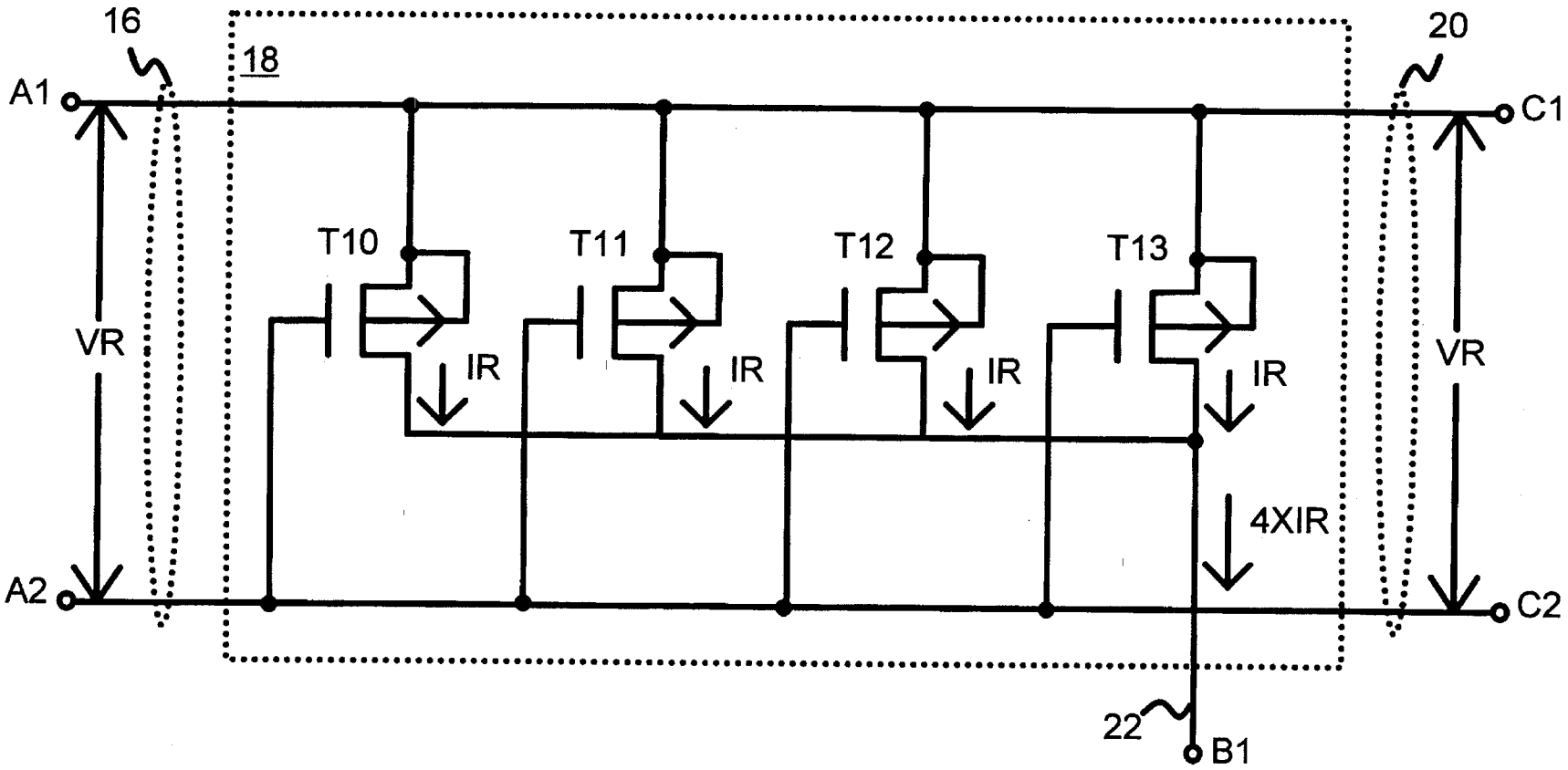
FIG. 4 is a diagram of one embodiment of the current multiplication means of FIGS. 1 and 2.

Attention is now directed to FIG. 4 which is a diagram of one embodiment of the current multiplication means 18 of FIGS. 1 and 2. Connecting points A 1 and A2 are electrically connected to points A 1 and A2 of FIG. 3A or in alternative embodiments to similarly labeled points of FIGS. 4B or 4C. Connecting point B1 is connected to B1 of FIG. 5 and points C1 and C2 are connected to similarly labeled points of FIGS. 8 and 10.

With reference still being made to FIG. 4, in one embodiment illustrated therein the current multiplication means 18 comprises a bank of 4 transistors labeled T10, T11, T12, and T13. This bank of transistors is connected in parallel to effectuate a multiplication of the established reference current IR. The reference voltage, which is connected across points A1 and A2, is also established across C1 and C2. By the flow of the reference current across T1 between points A1 and A2 and given that the resistance there across is relatively constant the voltage will be in relation to the reference current. In this embodiment each of the four transistors have been chosen to be equal. In other words, with the reference voltage across the line 16 junction, each of the four transistors can enable a similar level of the reference current therethrough at their respective outputs. Each of these transistors have been chosen to have the same characteristics such that each can pass the reference current. Thus, each transistor will effectuate a 1× multiplication of the reference current IR given the reference voltage. Thus, the combination of the four transistors taken together enables a 4× multiplication of the reference current. The 4× multiplied reference current 4×IR is directed into the voltage referencing means 24 along 22 to B1.

At this point it should be understood that although one embodiment of the current multiplication means 18 comprises a bank of 4 transistors so as to effectuate a 4× multiplication of the reference current, any number of transistors could be used to effectuate some other multiplication factor. For example, 3 transistors could be similarly implemented to effectuate a 3× multiplication of the reference current. Five transistors could be used if to effectuate a 5× multiplication, and so on. The point is to supply sufficient current to the voltage referencing means such that the desired number of voltage reference points can be established there across as will be explained further. Therefore, other configurations which effectuate reference current multiplication are envisioned herein. For instance, a source current generator with a 4× output triggering on VR could be used instead. Thus, current multiplication configurations other than the parallel connection of the embodiment described and illustrated herein could also be implemented as a the current multiplication means 18. Therefore, alternate configurations which effectively achieve any multiplication factor (even 1×) of the reference current IR whichever provide the voltage referencing means with sufficient supply are to be considered as being encompassed by the scope of the present invention.

Figure 5:
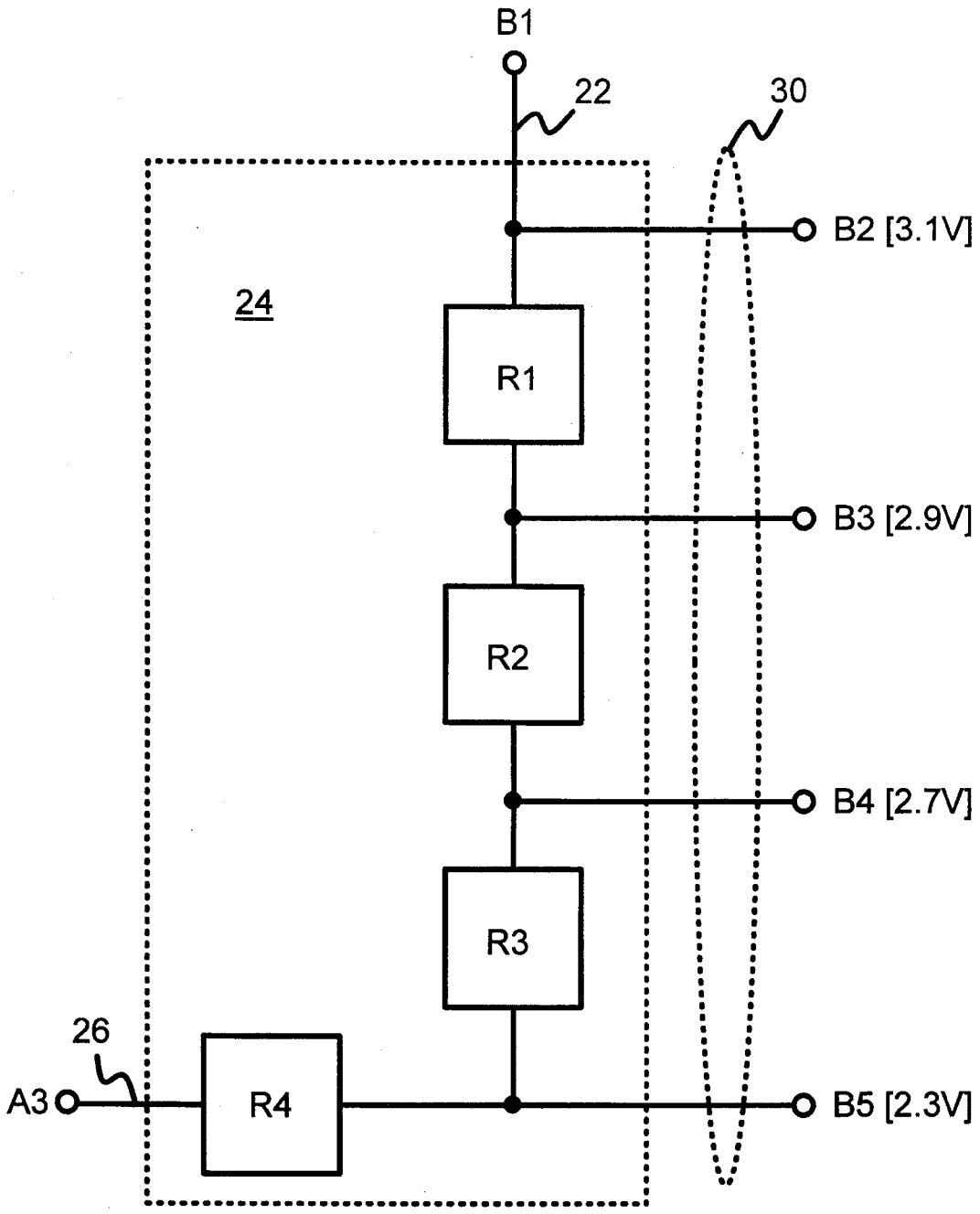
FIG. 5 is a diagram of one embodiment of the voltage referencing means of FIGS. 1 and 2.

Attention is now directed to FIG. 5 which is a diagram of one embodiment of the voltage referencing means 24 of FIGS. 1 and 2. The outputs, collectively designated as 30, tie the voltage referencing means to the comparator means 28. The diagrams of FIGS. 1 and 2 show multiple lines at 30 because any number of outputs could be taken depending on the configuration. Line 26 connects a ground with the reference generator means 10. A total of four resistive elements, labeled R1, R2, R3, and R4, create different voltage referencing values at B2, B3, B4, and B5. The example voltage points associated therewith are labeled in brackets. Resistive element R4 ties to ground to provide an appropriate drain. Connecting point B1 is connected to B1 of FIG. 4 and A3 is connected to A3 of either FIGS. 3A, 3B, or 3C.

In this embodiment, a series of voltage reference points are established to be used in conjunction with the comparator means 28 to which the ramping level of an input voltage 38 will be compared against. In other words, as the level of the input voltage rises up it should cross successive increasing thresholds in the comparator means. Thus, it is important that the successive voltage reference points be of increasing value from bottom to top (as illustrated). For instance, at point B3 the voltage would be less than that at point B2 because of the drop across the resistive element R1 therebetween. The resistive elements can be selected to provide the desired voltage reference points to which the ramping level of the input voltage 38 can be compared against. In this embodiment only four reference levels have been designated. In brackets are example voltage reference levels which will be used herein to help one understand this invention by way of example. It should be understood that any number of voltage reference points could be established by the voltage referencing means in order to achieve whatever degree of refinement in the detection of the ramping voltage level of the input voltage 38. For instance, if 10 gradations were desired then 10 distinct referencing points would have to be established separated by differing resistive elements between each point and sufficient current would have to be generated by the current multiplication means 18 and made available at B1. This is why the embodiments of FIGS. 1 and 2 illustrate a plurality of outputs at 30. Therefore, other embodiments of the voltage referencing means establishing any number of voltage referencing points (even 1) for comparison to the level of the input voltage 38 in the comparator means are to be considered within the scope of the present invention.

Figure 6A:
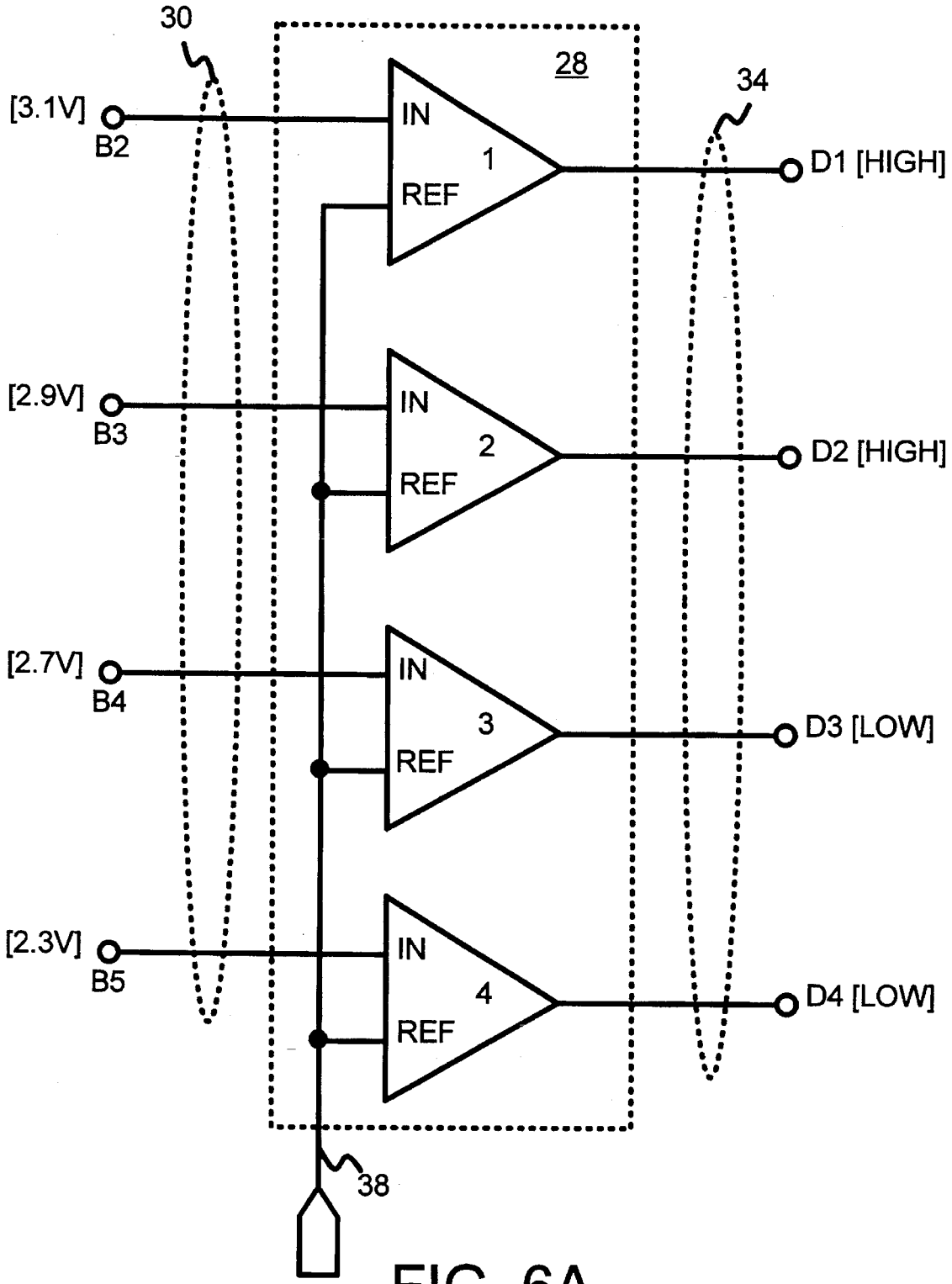
FIG. 6A is a diagram of one embodiment of the voltage comparator means of FIGS. 1.

Attention is now respectfully directed to FIG. 6 which is a diagram of one embodiment of the comparator means 28 of FIG. 1. In brackets to the left are the voltage reference valves produced as a result of the function of the voltage referencing means. Since the embodiment of the voltage referencing means 24 of the present invention was configured to have a total of 4 reference points a matching number of 4 comparators have been implemented. Connecting points B2, B3, B4, and B5 tie to the corresponding points of the voltage referencing means of FIG. 4. This embodiment has 4 comparators, labeled 1, 2, 3, and 4 with each having the IN line tied directly to the corresponding reference outputs and with each having the REF line tied to the input line of the input voltage for comparison purposes. The outputs, collectively designated as 34, connect with either the current output means 32 of the embodiment of FIG. 1 or with the latching means 40 and the reset means 42 of the embodiment of FIG. 2. The diagrams of FIGS. 1 and 2 show multiple lines at 34 because any number of outputs could be taken depending on the configuration. To the right in brackets are the states of the corresponding outputs which will be explained as part of an example provided herein.

In order to effectuate the comparison, the embodiment illustrated incorporates four voltage comparators enabled by a common voltage supply. The respective power and grounding connections have been omitted from the drawings for simplicity and clarity. One skilled in this art should readily understand the function of these omitted connections and how to implement them. The voltage comparators are configured to accept two inputs one of which is designated IN and the other REF. These comparators generate a HIGH at the output if the value of REF is below that of IN and a LOW otherwise. The functionality of the comparator configuration of FIG. 6A will now be by way of example in conjunction with the drawings. The detailed description of the embodiment of FIG. 6B will be discussed later in conjunction with the description of the embodiment of FIG. 2.

The level of the input voltage 38 upon start-up will be OFF or at ground. As the level of the input voltage charges or ramps up it, for example purposes past the 2.3 V level, the REF becomes higher than IN forcing the output of comparator 4 to a LOW state. Thus, D4 is LOW. As the input voltage 38 continues to ramp up, for example purposes past the 2.7 V level, the value of REF becomes greater than that of IN at comparitor 3 forcing the output of comparator 3 to LOW state. Thus, line D3 goes LOW. Assume that the final ramping level of the input voltage is greater than 2.7 V but less than 2.9 V. Thus, the input voltage will level off somewhere in between. For comparators 2 and 1 the level of IN will be greater than the level of input voltage thereby producing a HIGH at each of their respective outputs. The final states at D3 and D4 are LOW and D1 and D2 are HIGH.

In this embodiment, the designated referencing values have tied to the IN of each comparator while the input voltage 38 has been tied to each REF input in order to effectuate the comparisons. In the alternative, the outputs of the referencing means and the input voltage could be first inverted then tied to the opposite comparator inputs. Furthermore, other configurations with varying amounts and kinds of comparators can be used in the alternative to effectuate the same result. For instance, a differing number such that a 1-to-many or a many-to-1 ratio of comparators to available referencing means outputs could be implemented. Therefore, other embodiments having alternative configurations wherein the defined number of referencing outputs are compared with the ramping level of the input voltage are to be considered envisioned herein and within the scope of the present invention.

With the status of each of the 4 comparator outputs set, attention is now directed back to FIG. 1 wherein the outputs of the comparator means 28 tie directly into the current output means 32 over lines 34. In order to complete the description of this embodiment prior to completing the description of the embodiment of FIG. 2, reference is now being made to FIG. 7 which is a diagram of the embodiment of the current output means 32 of FIG. 1.

In this embodiment two rows totaling seven transistors are illustrated. The upper row of four transistors, labeled T24, T23, T22, and T21, are connected to points C1 and C2 and thus to the reference voltage VR. The bottom bank of transistors, labeled T25, T26, T27, and T28 act as switches. These p-channel devices, when turned on by a LOW signal, let the current flow therethrough. In other words, the bottom bank of transistors are configured such that when their respective lines D1-D4 are at a LOW state the current is enabled to flow. Conversely, when lines D1-D4 are at a HIGH state the current does not flow. For example, when the line D1 is LOW the input for T25 is LOW and this transistor is turned on and the current 14 is allowed to flow in the direction of the accompanying arrow. In such a manner, each transistor which is turned on enables a current component to flow in the direction of the accompanying arrow. This current component will be added to output line 36 and thus added to the total output which will be the summation of components I1+I2+I3+I4.

What is important to note in this particular configuration is that no current will flow until at least one of the lines D1-D4 goes LOW. If it is desired to have at least some current flowing to output line 36 prior to the ramping of the input voltage 38 then an additional non-switched transistor would have to be added to the configuration of FIG. 7. To effectuate this, an additional transistor T20 is also illustrated therein in block diagram. This additional transistor T20 would be of the type that would allow a certain predetermined component of the reference current IR to flow to the output line 36 independent of the result of the final states of lines D1-D4.

Figure 7:
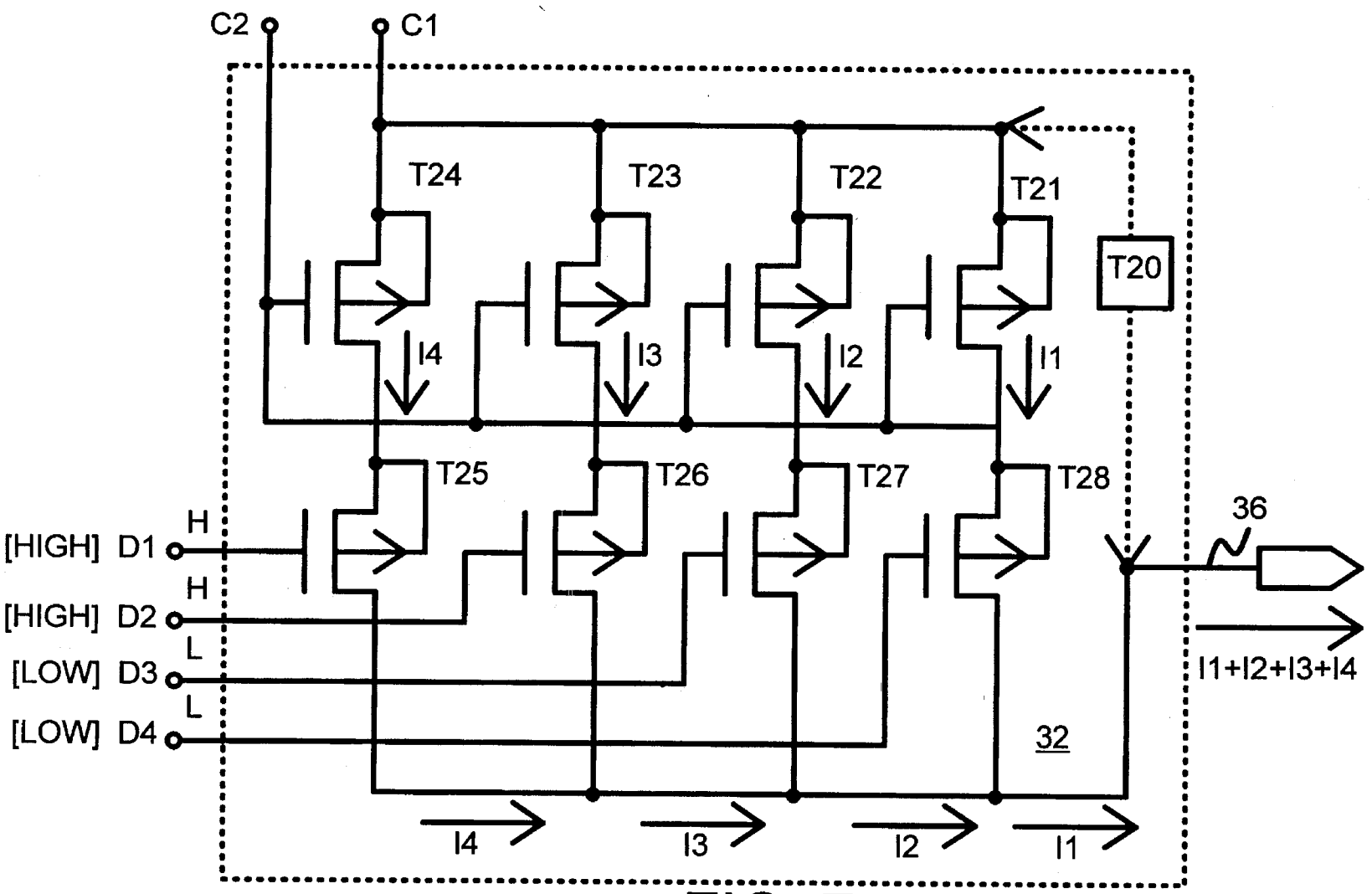
FIG. 7 is a diagram of one embodiment of the current output means of FIG. 1.

What is particularly important with respect to the top bank of 4 transistors in FIG. 7 is that each transistor is designated to allow only a predetermined fraction of the reference current IR through once switched on. For instance and with reference being made now to FIG. 8, a table of the ratios of one configuration of the top bank of the current output means is provided. These ratios represent the predetermined desired amounts of the reference current IR which is allowed to flow through the top bank of transistors as current components I1-I4. It is a number chosen for ease of divisibility. For example, assume that the reference current is composed of 32 units of IR. It should be understood that IR could be composed of 40 units or 10 units depending on the ratios of amounts of current to be made available at the current output 36 reactive to the level of input voltage. In this embodiment, it is desired to produce a relatively large amount of IR quickly as the input voltage ramps up and then supply selected smaller amounts in stages thereafter.

As configured, transistor T24 when switched will effectively deliver 20 units of IR as I4 in the direction of the accompanying arrow. In effect, this is 20/32 of the total IR amount or I4=(5/8)IR. Transistor T23, when switched, will effectively deliver 12 units of IR as 13. This is 12/32 of the total IR amount or I3=(3/8)IR. Transistor T22, when switched, will effectively deliver 8 units of IR as I2. This is 8/32 of the total IR amount or I2=(1/4)IR. Lastly, T21 will deliver a total of 24 units of IR as I1. In effect, this is I1=(3/4)IR. In other words, when either of D1, D2, D3, or D4 lines goes LOW an amount of current will be added to the output. If the block diagram transistor T20 is implemented to always deliver an amount of IR to the output then these amounts will be added to the current flowing therethrough. In that case at least some value of IR will always be available at the output.

Now with respect to the current running example, lines D1 and D2 were set HIGH and D3 and D4 were set LOW. Thus, the output current 36 will have a component of (3/4)IR from T21. Because D3 is LOW the output current 36 will also have a (8/32)IR component delivered as 12. Because D2 and D1 were both set HIGH, no current flowed therethrough. The total amount of current at the output is the sum of the I1, I2, I3, and I4 which is in this example is (24/32)IR+(8/32)IR.

Figure 11:
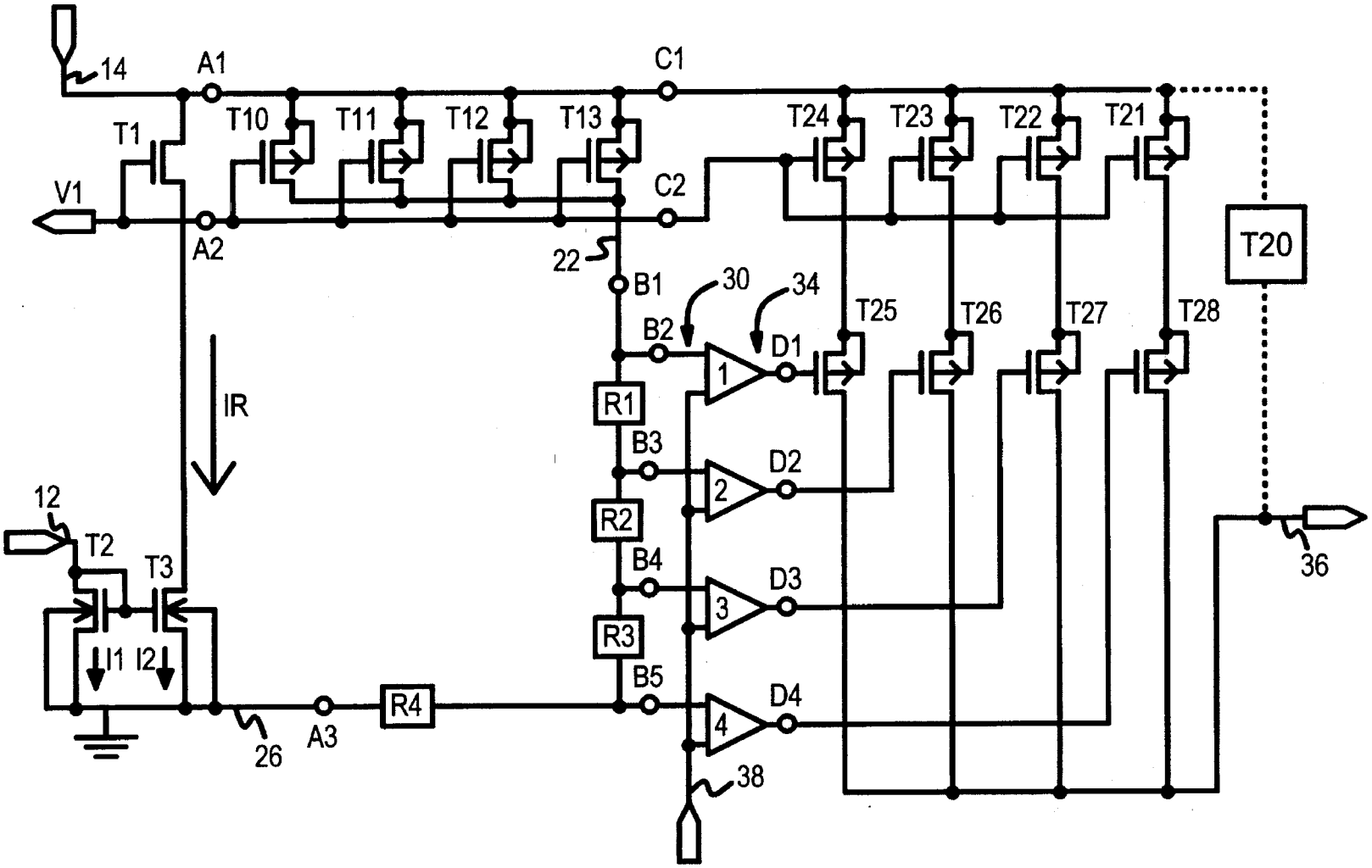
FIG. 11 is a diagram of one embodiment of the circuit of the present invention incorporating the individual configurations of FIGS. 3A, 4, 5, 6A, and 7 as shown in block diagram in FIG. 1.

The composite circuit of FIG. 1 is illustrated in FIG. 11 which is a diagram of one embodiment of the circuit of the present invention incorporating the individual configurations of FIGS. 3A, 4, 5, 6A, and 7.

To summarize briefly the embodiment of FIG. 1, a reference current and a reference voltage which followed the values of the bias voltage and bias current were established by the combination of a transistor and a current mirror means. The reference current was multiplied by a factor of four. A set of predetermined voltage reference points were established in the voltage referencing means and sufficient current supplied there across by the current multiplication means. The ramping values of the input voltage 38 were then compared to the voltage reference points in the comparison means the outputs of which flagged the highest voltage reference point which the value of the input voltage crossed. In the current output means these comparator outputs trigger predetermined incremental values of the reference current to be delivered to the output. In such a manner, an incremental output source current is generated which is dependent on an input voltage level and predetermined incrementally by the value of an established reference current.

Attention is now directed to the embodiment of FIG. 2 which incorporates a latching means 40 and a reset means 42. In addition, the comparator means 28 and the current output means 32 are configured differently. The same example will be used throughout to explain this particular embodiment of the present invention.

Figure 6B:
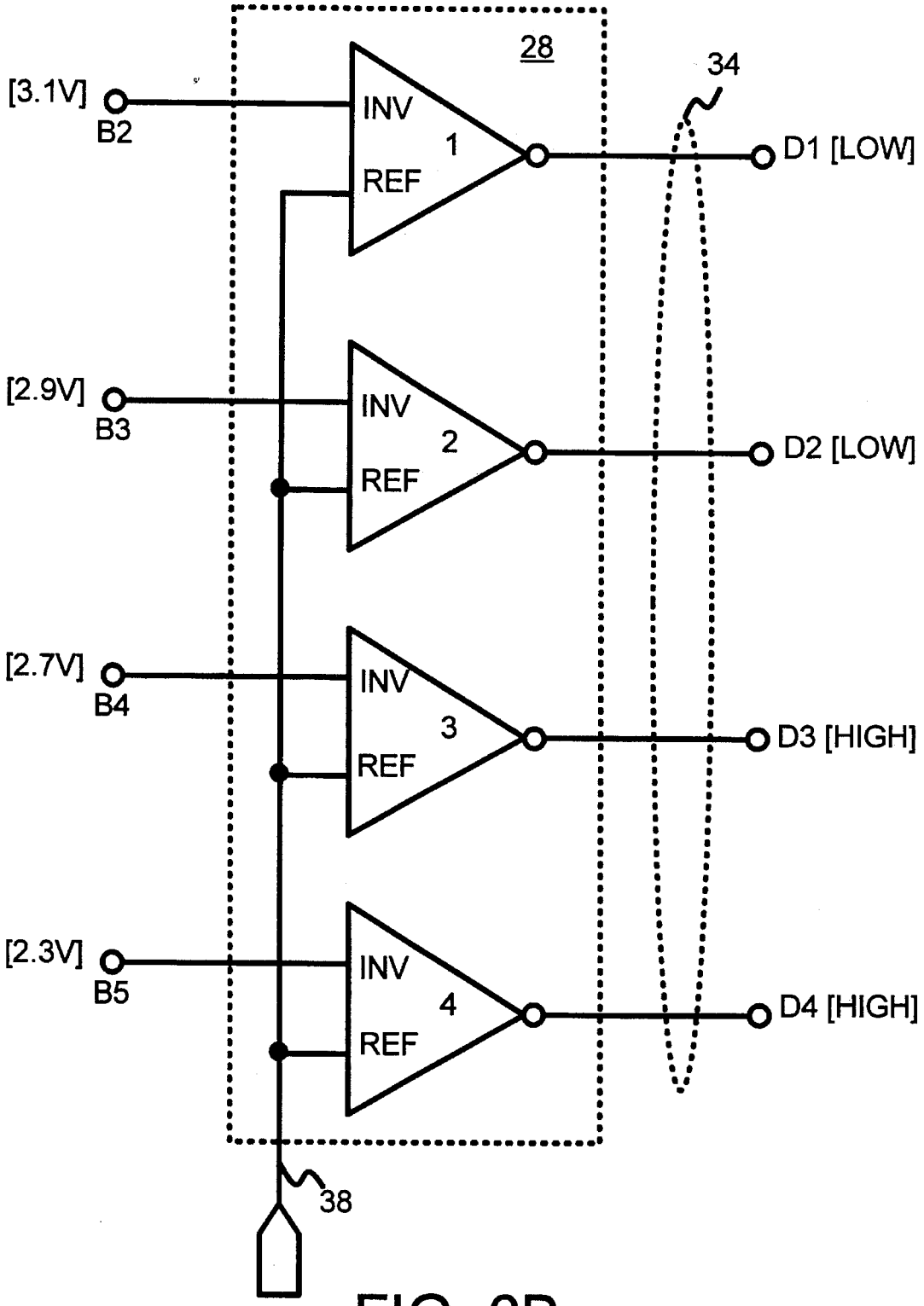
FIG. 6B is a diagram of an alternative embodiment of the voltage comparator means of FIGS. 3.

In this regard, reference is now being made to FIG. 6B which is a diagram of the voltage comparator means incorporated into the embodiment of FIG. 2. This comparator means has four voltage comparators enabled by a common voltage supply with their respective power and grounding connections omitted. These voltage comparators are also configured to accept two inputs one of which is designated INV and the other REF. These particular comparators generate a HIGH at the output if the value of REF is below that of INV and a LOW otherwise.

By way of continuing example, as the level of the input voltage ramps up it passes the 2.3 V reference point. The REF becomes higher than INV thereby forcing the output of comparator 4 line D4 to HIGH. As the input voltage continues to ramp up, for example purposes past the 2.7 V reference level, the value of REF becomes greater than that of INV at comparator 3 forcing the output of comparator 3 line D3 to HIGH. Again, the final ramping level of the input voltage was greater than 2.7 V but less than 2.9 V. As a result, the final states as indicated in brackets at D1 and D2 are LOW and D3 and D4 are set HIGH.

The embodiment of FIG. 2 also incorporates a latching means and a reset means between the outputs of the comparator means and the current output means. Reference is now being made to the FIG. 9 which is a diagram of the embodiment of the latching means and the reset means of FIG. 2. In this embodiment a set of 6 NOR gates (3 pairs connected in tandem) have points D1, D2, and D3 as inputs thereto. A set of 4 inverters three of which are connected to the outputs of the tandem set of gates for inversion thereof and one having D4 as an input. Once again, the respective power and grounding connections have been omitted from the drawings for simplicity and clarity because one skilled in this art should readily understand the function of these omitted connections and how to effectively implement them. Points D1, D2, D3, and D4 are electrically connected to their corresponding points and E1, E2, and E3 are connected to their respective points.

The start-up states of the NOR, in this configuration, do not have to be commonly set because of the reset means 35. In this regard, one skilled in this art should understand that the functionality of a NOR gate is such that the output is LOW if any (or both) of the inputs are HIGH else the output is HIGH. Since the desired initial state is LOW, in order to effectuate a reset both of the input lines of each of the NOR gates must be made LOW. As discussed, upon start-up the output of each of the 4 comparators is set LOW. So the reset must set the other input lines to LOW to allow reaction to other signals. When the output, at line 46, of the reset invertor is HIGH nothing can happen in the latching means. Since the start-up output of D4 is LOW, this causes the output of the reset inverter to go HIGH. At this point nothing can happen in the latching means. At the point wherein the level of the input voltage forces D4 HIGH by crossing the threshold voltage reference value thereof, the LOW output of the reset invertor effectively readies the latching means to be sensitive to incoming signals thereby assuring the correct initial state of the NOR gates.

At the completion of the ramping of the input voltage 38, the states of lines D1-D4 are LOW, LOW, HIGH, and HIGH respectively. With the combination of the feedback from the second stage of the latching means with the LOW on the output of the reset invertor, the corresponding states of lines El-E3 are HIGH, HIGH, and LOW respectively, as is shown.

It should be understood that although the configuration of one embodiment of the latching means and reset means of the preset invention is shown as such, other means could effectuate a similar output at points E1-E3 using other means such as NAND gates or transistors or other circuitry. Other embodiments thus envisioned would also have a means associated therewith to effectuate a reset if that particular configuration was such that the initial states had to be effectively known and controllable. It is envisioned that some configurations could function without the reset means entirely. In addition, the latching means could have a locking mechanism added to it in order to prevent jitter when and if the input voltage drifts. Therefore, other embodiments of the latching means with or without the accompanying reset means are to be considered within the scope of the present invention.

Figure 9:
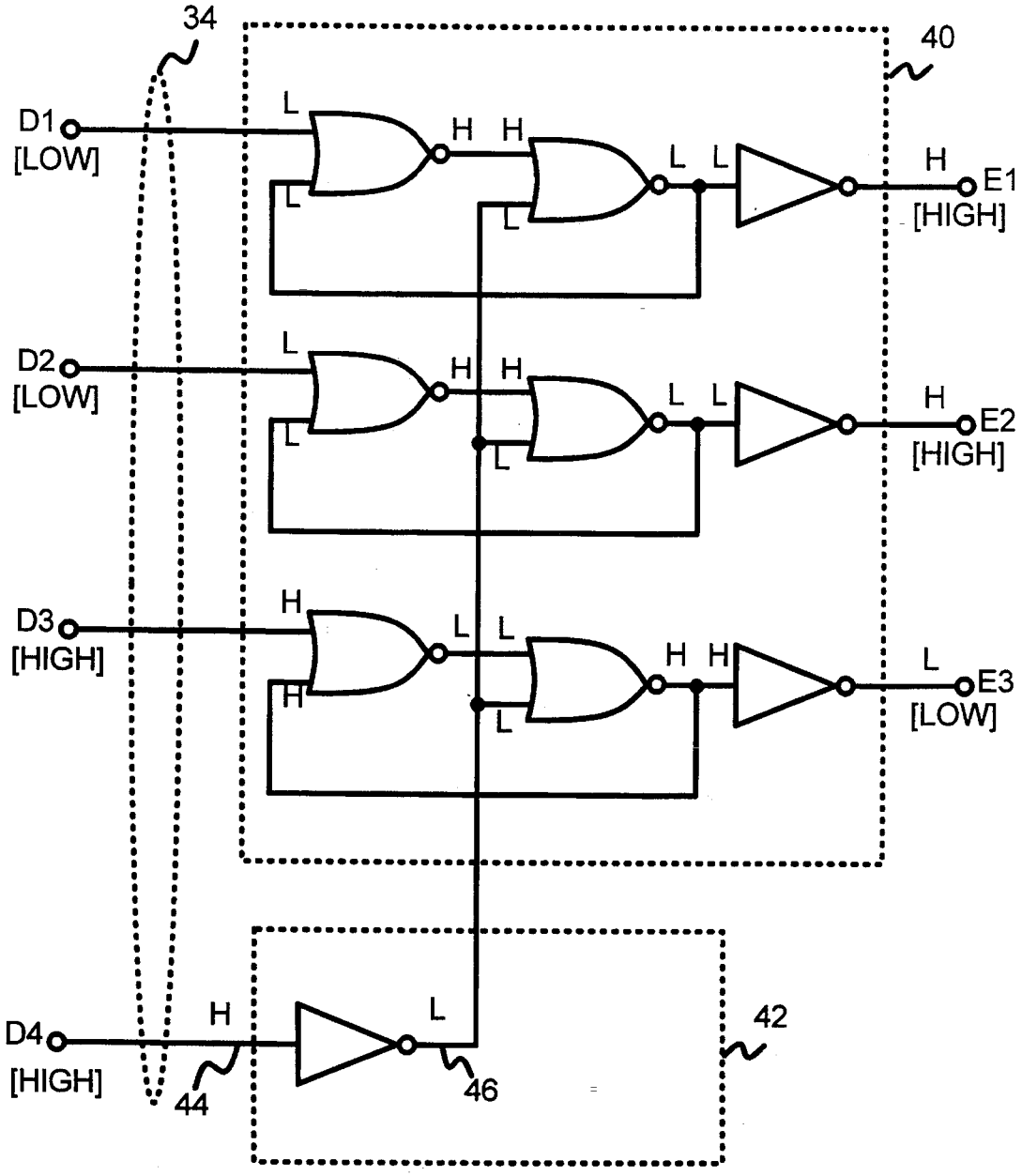
FIG. 9 is a diagram of one embodiment of the latching means and the reset means of FIG. 2.
Figure 10:
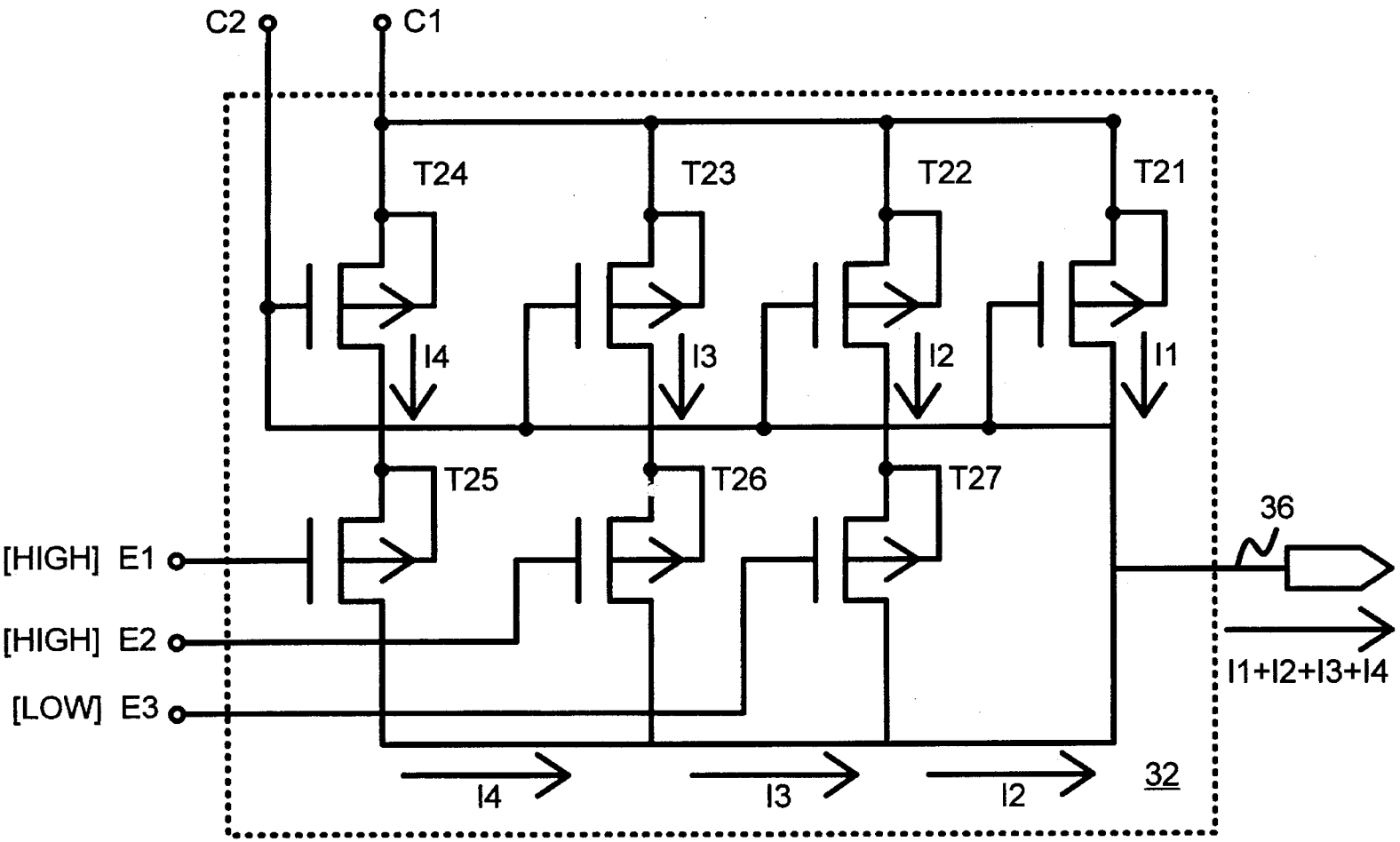
FIG. 10 is a diagram of another embodiment of the current output means of FIG. 2.

Attention is now directed to FIG. 10 which is a schematic diagram of another embodiment of the current output means 32 of FIG. 2 which accepts its input from the latching means of FIG. 9. In this embodiment two rows totaling seven transistors are illustrated. The upper row of four transistors, labeled T21, T22, T23, and T24, are connected to the reference voltage VR across the C2-C1 junction. The bottom row of transistors, labeled T25, T26, and T27 act as switches thereto. In the embodiment, transistor T21 is tied directly to the current output line 36. These p-channel transistors, when turned on by a LOW, let the current flow therethrough.

In terms of the present example, reference is again being made to FIG. 8 which is a table of the ratios of one configuration of the top bank of the current output means. As configured, transistor T24 when switched will effectively deliver 20 units of IR to the output as 14. Transistor T23 will effectively deliver 12 units of IR to the output as 13. Transistor T32 will deliver 8 units of IR to the output as 12. Lastly, in this configuration transistor T21 will always deliver a total of 24 units of IR to the output as I1. Thus, at least ¾ the value of IR will at least be available as the Output current 36.

Now with respect to the example provided previously, lines E1 and E2 were set HIGH and E3 was set LOW. Thus, the output current 36 will have at least a (¾ )IR component from I1. Because E3 is LOW transistor the output current 36 will also have a (8/32)1R component delivered as 12. Because E2 and E1 were both set HIGH no current flowed therethrough. The total amount of IR is the sum of the I1, I2, and I4 components which is in this example is (24/32)IR+(8/32)IR=(32/32)IR=(1)IR.

At this point it should be clearly understood that any amount of current output could be effectuated by additional transistors (switched or not) which provide the desired added level of output current as the level of the input voltage ramps. These embodiments are to be considered within the scope of the present invention.

Figure 12:
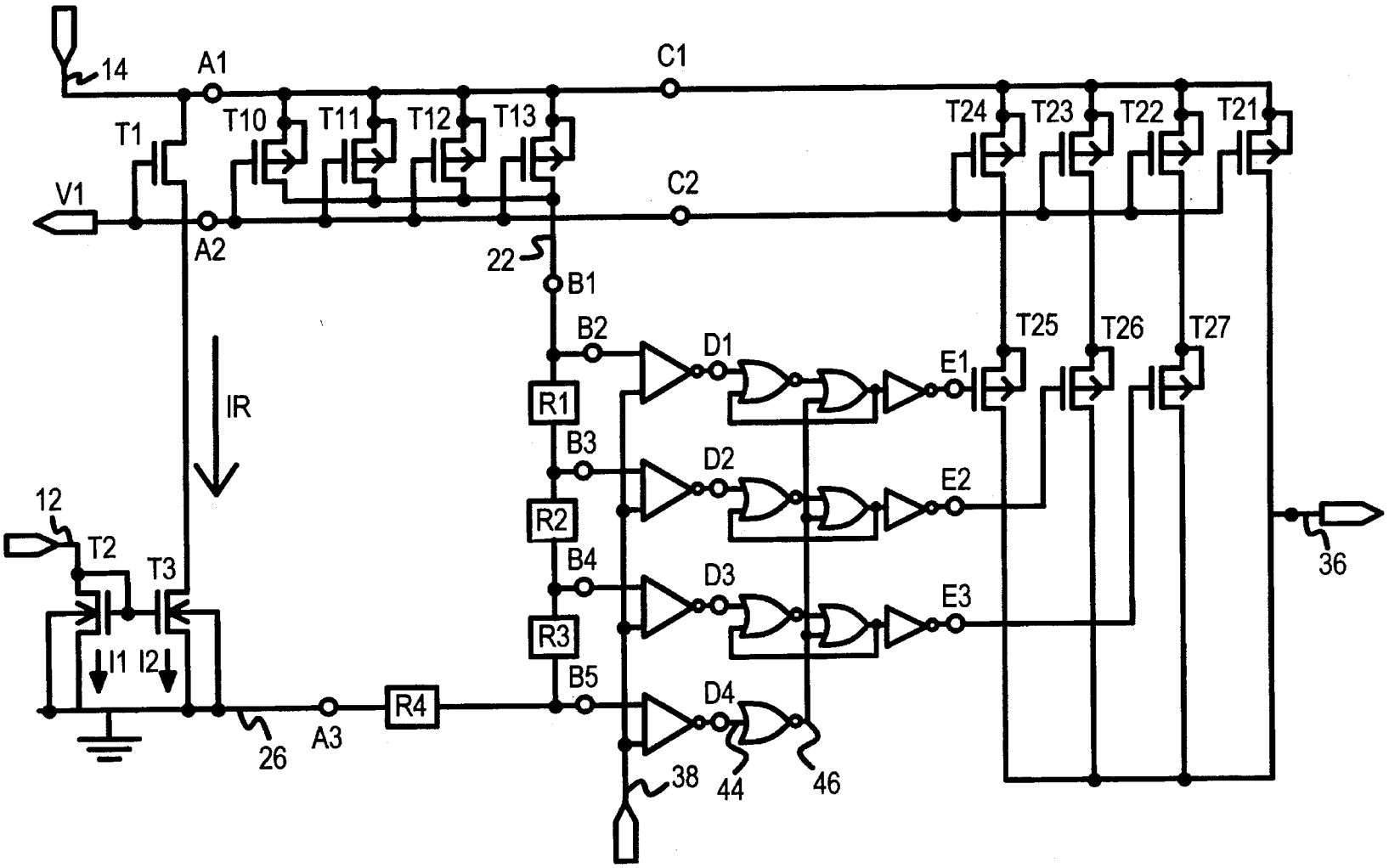
FIG. 12 is a diagram of the preferred embodiment of the circuit of the present invention incorporating the individual configurations of FIGS. 3A, 4, 5, 6B, 9, and 10 as shown in block diagram in FIG. 2.

The composite circuit of FIG. 2 is illustrated in FIG. 12 which is a diagram of the preferred embodiment of the circuit of the present invention incorporating the individual configurations of FIGS. 3A, 4, 5, 6B, 9, and 10.

To summarize briefly the preferred embodiment of FIG. 2, similar to FIG. 1 a reference current and a reference voltage which followed the values of the bias voltage and current were established by the combination of a transistor and a current mirror means. The reference current was multiplied by a factor of four. A set of predetermined voltage reference points were established in the voltage referencing means and sufficient current supplied there across by the current multiplication means. The ramping values of the input voltage were then compared to the voltage reference points in the comparison means the outputs of which flagged the highest voltage reference point which the value of the input voltage crossed. These outputs are directed into a latching means for holding the signal steady and a reset means. In the current output means these outputs trigger predetermined incremental values of the reference current to be delivered to the output as the output current. In such a manner, an incremental output source current is generated which is dependent on an input voltage level and predetermined incrementally by the value of an established reference current.

With such a circuit as in the present invention, because the output current can be quickly ramped to a predetermined level the overall time required to test a die can be shortened because the circuit turn-on time is much quicker. In addition, this output current can also be used to adjust the changing current in the Phase Detector because that circuit typically has a charge pump in it.

While one embodiment of this invention has been disclosed, it should be understood that the present disclosure merely exemplifies the principles of this invention. It is not intended to limit the invention to the embodiment illustrated and discussed herein. As such the present invention may be embodied in other specific forms without departing from the spirit of this invention or its essential characteristics. The described embodiments are to be considered, in all respects, as illustrative and not restrictive. The scope of the invention is, therefore, indicated by the appended claims rather than by the foregoing description. All changes which come within the meaning and range of equivalency of the foregoing claims are to be embraced within their scope.

What is claimed and desired to be secured by United States Letters Patent is:

1. An incremental current generation circuit for generating an output current comprising:

a) a reference generation means for generating a reference current therethrough and a reference voltage thereacross;

b) a current multiplication means electrically connected to the reference generation means for multiplying the reference current therethrough and making the multiplied current available as an output;

c) a voltage referencing means electrically connected between the current multiplication means and the reference generation means accepting the output multiplied current of the current multiplication means as an input and comprising a resistive element for establishing at least one voltage reference point there across which is accessible as an output;

d) a comparator means receiving the at least one voltage reference point output for comparing the reference point against a level of an input voltage provided to the comparator means and having outputs directed therefrom; and e) a current output means accessing the reference voltage of the reference generation means and receiving the output of the comparator means for producing a current at the output, wherein the output of the comparator means trigger at least one predetermined value of the reference current to be delivered to the output of the current output means.

2. The current generation circuit of claim 1 wherein the reference generation means comprises at least one transistor coupled at one end to a source voltage power supply and at another end to the current multiplication means.

3. The current generation circuit of claim 2 wherein the current multiplication means comprises at least two transistors to mirror a bias current into a reference current and having a bias voltage there across and a bias current therethrough.

4. The current generation circuit of claim 3 further comprising a sleep-mode means comprising at least one transistor configured with the at least two transistors and having a state generation line to turn ON/OFF the reference current.

5. The current generation circuit of claim 1 wherein the current multiplication means comprises at least one transistor configured to effectuate a multiplication of the reference current therethrough.

6. The current generation circuit of claim 1 wherein the current multiplication means comprises a bank of four transistors configured to effectuate a predetermined multiplication of the reference current therethrough.

7. The current generation circuit of claim 6 wherein the transistors in the bank of transistors have differing current passing percentage characteristics.

8. The current generation circuit of claim 6 wherein the bank of transistors are each connected in parallel.

9. The current generation circuit of claim 1 wherein the current multiplication means comprises a source current generator with a multiplied reference current output triggered in the reference voltage established in the voltage referencing means.

10. The current generation circuit of claim 1 wherein the voltage referencing means further comprises a plurality of resistive elements for establishing a plurality of voltage referencing points there across with each point accessible as an output in order to provide finer reference increments for comparison with the level of the input voltage.

11. The current generation circuit of claim 1 wherein the comparator means comprises at least one voltage comparator connected to the reference output from the voltage referencing means and to the input voltage for comparison therewith.

12. The current generation circuit of claim 1 wherein the comparator means comprises at least one voltage comparator connected to the reference output from the voltage referencing means and to the input voltage for comparison therewith and having an inverted output.

13. The current generation circuit of claim 1 wherein the current output means comprises at least one transistor switchable at the input by the output of the comparator means for enabling a current.

14. The current generation circuit of claim 1 wherein the current output means comprises at least two transistors wherein a first transistor provides current therethrough switchable by a second transistor activated at the input by the output of the comparator means.

15. The current generation circuit of claim 1 further comprising a latching means interfaced to the output of the comparator means for post-comparison stability.

16. An incremental current generation circuit for generating an output current comprising:

a) a reference generation means for generating a reference current therethrough and a reference voltage thereacross;

b) a current multiplication means electrically connected to the reference generation means for multiplying the reference current therethrough and making the multiplied current available as an output;

c) a voltage referencing means electrically connected between the current multiplication means and the reference generation means accepting the output multiplied current of the current multiplication means as an input and comprising a resistive element for establishing at least one voltage reference point there across which is accessible as an output;

d) a comparator means receiving the at least one voltage reference point output for comparing the reference point against a level of an input voltage provided to the comparator means and having outputs directed therefrom;

e) a latching means connected to at least one output from the comparator means for post-comparison stability;

f) a reset means connected to at least one output of the comparator means for enabling a reset of the latching means; and g) a current output means accessing the reference voltage of the reference generation means and receiving the output of the comparator means for producing a current at the output, wherein the output of the comparator means trigger at least one predetermined value of the reference current to be delivered to the output of the current output means.

17. The current generation circuit of claim 16 wherein the reference generation means comprises at least one transistor coupled at one end to a source voltage power supply and at another end to the current multiplication means.

18. The current generation circuit of claim 17 wherein the current multiplication means comprises at least two transistors to mirror a bias current into a reference current and having a bias voltage there across and a bias current therethrough.

19. The current generation circuit of claim 18 further comprising a sleep-mode means comprising at least one transistor configured with the at least two transistors and having a state generation line to turn ON/OFF the reference current.

20. The current generation circuit of claim 16 wherein the current multiplication means comprises at least one transistor configured to effectuate a multiplication of the reference current therethrough.

21. The current generation circuit of claim 16 wherein the current multiplication means comprises a bank of four transistors configured to effectuate a predetermined multiplication of the reference current therethrough.

22. The current generation circuit of claim 21 wherein the transistors in the bank of transistors have differing current passing percentage characteristics.

23. The current generation circuit claim 21 wherein the bank of transistors are each connected in parallel.

24. The current generation circuit of claim 16 wherein the current multiplication means comprises a source current generator with a multiplied reference current output triggered in the reference voltage established in the voltage referencing means.

25. The current generation circuit of claim 16 wherein the voltage referencing means further comprises a plurality of resistive elements for establishing a plurality of voltage referencing points there across with each point accessible as an output in order to provide finer reference increments for comparison with the level of the input voltage.

26. The current generation circuit of claim 16 wherein the comparator means comprises at least one voltage comparator connected to the reference output from the voltage referencing means and to the input voltage for comparison therewith.

27. The current generation circuit of claim 16 wherein the comparator means comprises at least one voltage comparator connected to the reference output from the voltage referencing means and to the input voltage for comparison therewith and having an inverted output.

28. The current generation circuit of claim 16 wherein the current output means comprises at least one transistor switchable at the input by the output of the comparator means for enabling a current.

29. The current generation circuit of claim 16 wherein the current output means comprises at least two transistors wherein a first transistor provides current therethrough switchable by a second transistor activated at the input by the output of the comparator means.

30. The current generation circuit of claim 29 wherein the latching means further comprises at least one NOR gate and further comprising an equal number of inverters connected to the output of the at least one NOR gate for inversion of the output signal prior to input into the current output means.

31. The current generation circuit of claim 16 wherein the current output means comprises at least two transistors wherein a first transistor provides current therethrough switchable by a second transistor activated at the input by the output of the comparator means.

32. An incremental current generation circuit for generating an output current comprising:

a) a reference generation means for generating a reference current therethrough and a reference voltage thereacross comprising at least two transistors to mirror a bias current into a reference current and having a bias voltage there across and a bias current therethrough;

b) a current multiplication means electrically connected to the reference generation means for multiplying the reference current therethrough and making the multiplied current available as an output and further comprising a bank of four transistors configured to effectuate a predetermined multiplication of the reference current therethrough;

c) a voltage referencing means electrically connected between the current multiplication means and the reference generation means accepting the output multiplied current of the current multiplication means as an input and comprising a resistive element for establishing at least one voltage reference point there across which is accessible as an output and further comprising a plurality of resistive elements for establishing a plurality of voltage referencing points there across with each point accessible as an output in order to provide finer reference increments for comparison with the level of the input voltage;

d) a comparator means receiving the at least one voltage reference point output for comparing the reference point against a level of an input voltage provided to the comparator means and having outputs directed therefrom and the comparator means comprising at least one voltage comparator connected to the reference output from the voltage referencing means and to the input voltage for comparison therewith;

e) a latching means connected to at least one output from the comparator means for latching on to the output of the comparator means;

f) a reset means connected to at least one output of the comparator means for enabling a reset of the latching means; and g) a current output means accessing the reference voltage of the reference generation means and receiving the output of the comparator means for producing a current at the output, wherein the output of the comparator means trigger at least one predetermined value of the reference current to be delivered to the output of the current output means, the current output means comprising at least two transistors wherein a first transistor provides current therethrough switchable by a second transistor activated at the input by the output of the comparator means.

33. The current generation circuit of claim 32 further comprising a sleep-mode means comprising at least one transistor configured with the at least two transistors and having a state generation line to turn ON/OFF the reference current.

34. The current generation circuit of claim 32 wherein the current multiplication means comprises a source current generator with a multiplied reference current output triggered on the reference voltage established in the voltage referencing means.

35. The current generation circuit of claim 32 wherein the comparator means has an inverted output.

36. The current generation circuit of claim 32 wherein the latching means further comprises at least one gate receiving the output of the comparator means and comprising an equal number of inverters connected to the output of the at least one gate to invert the output signal prior to input into the current output means.

* * * * *